US006431094B1

(12) United States Patent
Gregg

(10) Patent No.: US 6,431,094 B1
(45) Date of Patent: Aug. 13, 2002

(54) REACTIVE WASTE DEACTIVATION FACILITY AND METHOD

(75) Inventor: Ronald E. Gregg, Dana Point, CA (US)

(73) Assignee: Advanced Environmental Technology, Inc., Dana Point, CA (US)

( * ) Notice: Subject to any disclaimer, the term of this patent is extended or adjusted under 35 U.S.C. 154(b) by 0 days.

(21) Appl. No.: 09/782,505

(22) Filed: Feb. 13, 2001

(51) Int. Cl.[7] ..... F23G 7/00; F23J 1/02

(52) U.S. Cl. ..... 110/237; 110/165 R; 110/168; 588/202

(58) Field of Search ..... 422/189; 110/237, 110/166, 167, 168, 101 R, 165 R, 116, 117, 101 A; 588/202

(56) References Cited

U.S. PATENT DOCUMENTS

| | | | | | |
|---|---|---|---|---|---|
| 683,218 | A | * | 9/1901 | McElroy | 110/167 |
| 1,234,848 | A | * | 7/1917 | Wood | 110/167 |
| 1,799,206 | A | * | 4/1931 | Young | 110/101 |
| 2,076,815 | A | | 4/1937 | Fulweiler | 183/751 |
| 2,894,466 | A | * | 7/1959 | Martin | 110/169 |
| 3,225,721 | A | * | 12/1965 | Rowley | 110/167 |
| 4,098,586 | A | * | 7/1978 | Woodmansee | 48/76 |
| 4,154,685 | A | | 5/1979 | Marcotte | |
| 4,303,022 | A | * | 12/1981 | Etnestead | 110/245 |
| 4,320,709 | A | | 3/1982 | Hladun | |
| 4,478,126 | A | * | 10/1984 | Holmlund | 86/1 B |
| 4,673,413 | A | | 6/1987 | Strong | |
| 5,027,719 | A | * | 7/1991 | Chenard | 110/165 R |
| 5,062,372 | A | * | 11/1991 | Ritter | 110/242 |
| 5,207,176 | A | | 5/1993 | Morhard et al. | |
| 5,226,375 | A | * | 7/1993 | Fukuda | 110/346 |
| 5,298,196 | A | | 3/1994 | Heung | |
| 5,336,842 | A | | 8/1994 | Massholder et al. | |
| 5,407,647 | A | | 4/1995 | Tarancon | |
| 5,419,862 | A | | 5/1995 | Hampel | |
| 5,423,271 | A | | 6/1995 | Schulze | |
| 5,495,063 | A | | 2/1996 | Magenheimer et al. | |
| 5,527,983 | A | | 6/1996 | Tadmor et al. | |
| 5,614,156 | A | * | 3/1997 | Wang | 422/174 |
| 5,741,465 | A | | 4/1998 | Gregg | |
| 5,881,654 | A | * | 3/1999 | Fleming et al. | 110/237 |
| 5,884,569 | A | * | 3/1999 | Donovan | 110/346 |
| 5,901,759 | A | * | 5/1999 | Nickens et al. | 141/51 |
| RE36,912 | E | * | 10/2000 | Donovan | 110/237 |
| 6,173,662 | B1 | * | 1/2001 | Donovan | 110/237 |

* cited by examiner

*Primary Examiner*—Ira S. Lazarus
*Assistant Examiner*—K. B. Rinehart
(74) *Attorney, Agent, or Firm*—Walter A. Hackler

(57) ABSTRACT

The reactive waste deactivation facility includes a plurality of deactivation bays each being adapted to accommodate a different type or reactive waste which is to be deactivated therein. The deactivation bays are all enclosed within a common expansion chamber that is designed to collect waste gasses and other wastes resulting from the deactivations that take place in the plurality of bays. In addition, an air pollution control system is provided for cooling and treating the waste gasses before they are vented to the atmosphere. The facility may also include a remotely operable waste feeding system for enabling an operator to safely feed or charge each of the bays. A waste collection and removal system is also provided, which includes an individual, remotely operable, releaseable floor connected to each of the bays.

17 Claims, 6 Drawing Sheets

REACTIVE WASTE DEACTIVATION FACILITY AND METHOD

The present invention generally relates to the treatment of reactive wastes, and more specifically relates to systems and methods for the disposal of reactive waste materials, particularly those wastes listed by the United States Environmental Protection Agency under EPA waste code D003, for example military and industrial explosives, propellants and munition items that require special disposal. The present systems and methods utilize much of the approach and logic described in U.S. Pat. No. 5,741,465, to the same inventor, however the present systems and methods provide improvements thereto.

The regulation of the disposal of hazardous waste is now a well established law. A subset of hazardous waste, that being the explosive waste materials is also very strictly regulated. In the past such materials were disposed of by open burning and open detonation and by high temperature incineration. Open disposal has been banned in most places and high temperature incineration has proven to be far too expensive. While numerous incineration devices exist which can destroy these reactive materials, the cost of using these devices has eliminated them from competing in the open market place due to cost of reaching the 2200 degree F heating requirements imposed by the United States Environmental Protection Agency (US EPA) for these incinerators. Devices of this type are set forth in U.S. Pat. No. 5,207,176. The present invention provides a manner to deactivate explosive materials that is economical, protective of the environment, and which complies with the standards of the US EPA.

The present invention qualifies as Best Demonstrated Available Technology (BDAT) for the treatment of category D003 reactive waste as defined by the US EPA. To meet this US EPA standard, the facility is designed to meet the US EPA regulations codified at 40 CFR 264.600 for "Miscellaneous Units". The facility does not meet the standards of an incinerator as defined by US EPA in 40 CFR 264.340 "Incinerators".

Reactive wastes for which disposal is regulated by the US EPA are given the Hazardous Waste Code D003. Among the reactive wastes which must be treated in a controlled facility are detonators, gas generants, ammunition, pyrotechnics, propellants, emulsions, oxidizers, boosters, squibs, dynamite, explosive bolts, igniters, blasting caps, signals, smokes, flares, pharmaceuticals, grenades, mines, gunpowder, detonation cord, incendiary devices, explosive sludges, among others.

The present invention provides an improvement in design for the inexpensive disposal of these reactive wastes. For example, the facility in accordance with the present invention, can handle substantially larger detonations without damage thereto, in comparison to conventional incinerators. The facility in accordance with the present invention includes detonation bays which are highly armored are able to withstand high force detonations. Detonation devices within the detonation bays are designed to deflagrate propellants without the large expenditure of energy required by incinerators. The device heats items that pop only to the temperature required to initiate the reactions and takes advantage of the energetic material within the waste to complete the reaction. These and other features of the present invention provide substantial improvements over incinerators.

Further it should be appreciated that the processes for deactivating burnable or exploding reactive materials are significant because explosives are generally known of being capable of undergoing the quick chemical reaction of decomposition without the intervention of further reactants, especially without atmospheric oxygen. Because oxygen is not required for the decomposition of explosives, the process for deactivation is referred to as "deflagration" as opposed to combustion which, as is well known, takes place only with the addition of oxygen. A further explanation of deflagration of explosives is set forth in U.S. Pat. No. 5,423,271, which is incorporated herein by this specific reference thereto, to further distinguish the apparatus necessary for the deactivation of burnable and explosive materials.

The present design economically treats reactive wastes which burn or deflagrate, items which melt or pop, and items which undergo significant detonation without utilizing incineration temperatures and it does so economically and in compliance the regulations of the U.S. Environmental Protection Agency. None of the conventional, presently available systems and methods can accomplish this claim.

SUMMARY OF THE INVENTION

A reactive waste deactivation unit, or facility, in accordance with the present invention, is capable of continuously processing a wide spectrum of reactive wastes. This includes the previously enumerated list of reactive wastes and others falling into the three types of reactive waste described herein. Particularly, the facility contains a plurality of deactivation bays, each including a specific deactivation device providing means for initiating and sustaining a deactivation reaction in the deactivation bay. The plurality of deactivation bays are enclosed within a common outer expansion chamber. The expansion chamber stops shrapnel, controls and collects the emissions from each of the bays, collects the ash and residuals, minimizes noise, and routes all of the off gas, i.e. waste gases generated by the deactivation process, to an air pollution control system of an appropriate type to comply with federal, state, and local air emission regulations.

More particularly, the deactivation devices include different types of deactivation devices, each type of deactivation device being configured for deactivating a different class of reactive waste. Further, the facility may contain a plurality of each type of device.

Specifically, in one embodiment of the invention, the facility includes three different types of deactivation devices. More specifically, the three different types of deactivation devices include an electrical spark device for deflagrating burnable wastes, a direct contact heating device for melting and popping manufactured items, and a shielded, radiant heating device for deactivating munition items such as grenades and mines that undergo high order detonations. Any shrapnel produced by these reactions will be contained in the internal reaction bays while the heat, pressure, gas, and noise will be contained by the external expansion chamber.

The internal deactivation bays are designed of cylindrical steel barrels of sufficient strength to accommodate the reaction of the treated material. The external expansion chamber is designed to withstand the heat and pressure from all of the deactivation reactions and detonations produced from the reactions.

In accordance with a method of the present invention for substantially continuous deactivation of reactive waste, the waste is fed into each deactivation bay sequentially, and in a planned manner, by means of a feed chute mechanism extending between the deactivation bays and an outside operating platform. More particularly, each deactivation bay is provided with an individual feed chute having an accessible inlet adjacent the operating platform. A "feed charge" of reactive waste is placed in one or more of the feed chute inlets and then is fed into the deactivation bays, preferably in a sequential, planned manner, by remote operation of pneumatic-actuated rotary valves disposed on each feed chute. The feed chutes may be comprised of structural steel tube in tubular or rectangular shape.

Preferably, waste feed rates are carefully controlled to allow completion of treatment of each feed charge prior to the introduction of an additional feed charge into a given bay. For example, a first feed charge is introduced into one of the plurality of deactivation bays and after an appropriate time period is allowed to pass, a second feed charge is fed into the another one of the bays. In a specific embodiment of the present invention, four deactivation bays are provided. A typical cycle time required to sequentially charge all four of the bays would average about one minute. The charging cycle is then repeated as the time required to complete deactivation treatment in each bay averages about one minute as well. For safety reasons, the operator platform is positioned outside and above the expansion chamber. In addition, a blast wall may be provided for further separating the operators from reactions taking place in the unit.

In a specific embodiment of a method, in accordance with the present invention, for the continuous deactivation of reactive wastes, the method includes the step of separating the incoming wastes into three classes the first class being propellants and explosive powders burnable in an unconfined state without detonation thereof, a second class being manufactured devices capable of being melted or popped without a detonation, and a third class of munition items capable of being detonated in an armored bay.

In addition, the method may further comprise the steps of performing an analysis on the materials and the manufactured items, in accordance with a waste analysis plan, and determining an appropriate waste feed rate. The appropriate waste feed rate is a feed rate that the facility can safely process and that which will not exceed applicable air pollution standards.

Next, the method comprises the step of loading the determined allowable waste feed of each class into the deactivation bays, with each bay being suitable for deactivation of one of the three classes of reactive waste hereinabove set forth.

A computerized control system may be used to regulate the waste feeds, the heating of the bays, the system air flow, temperatures in the expansion chamber, the operation of an appropriate air pollution control system, and the cooling air to assure the system operates within safety standards and that it complies with the applicable air pollution control standards. The entire facility is designed and operated in a manner completely different from an "incinerator" as defined by the U.S. Environmental Protection Agency.

Importantly, the unit or facility in accordance with the present invention includes a residual waste removal system. Specifically, the waste removal system comprises a mechanism for removing ash, shrapnel and/or other materials accumulated in the deactivation bays. More specifically, each deactivation bay may include a releasable bay floor. For example, each treatment bay is equipped with an automatically operable, rotatable bay floor and release mechanism. Advantageously, this feature allows all residual material from the deactivation reactions to be dropped or "dumped" from the bottom of the bay, and into a lower portion of the expansion chamber. The lower portion of the expansion chamber may include structure, such as sloped surfaces, which define a common outlet through which all of the residuals will fall. In addition, the expansion chamber is preferably adapted to accommodate a movable container element, for example a wheeled cart, bin or hopper, to be passed under the outlet so that the ash, melted debris, shrapnel and other non-reactive residuals may fall by gravity into the container element for removal and disposal in a suitable manner.

The air pollution control system feature of the present invention may comprise a gas cooling system, a cyclone separator, a filtration unit and a venting stack. The cooling system may for example comprise a length of coiled or twisted ducting disposed between an outlet of the expansion chamber and a cyclone inlet. Preferably, the ducting has a length and structure which is conducive to providing initial cooling of hot waste gasses emitted from the expansion chamber before the gasses enter the cyclone. The cyclone serves to remove particulate matter from the cooled waste gasses and as a mixer to ensure a homogenous temperature of the gasses as the gasses enter the filtration unit. The filtration unit may comprise a bag house designed to thoroughly clean and filter the waste gasses prior to venting the gasses through the stack. A draft fan connected between the bag house and the stack provides for further cooling by inducing ambient air into cleaned waste gasses.

BRIEF DESCRIPTION OF THE DRAWINGS

These and other features and advantages of the present invention will be better understood by the following detailed description when considered in conjunction with the accompanying drawings in which.

DETAILED DESCRIPTION

Contained Burn Vessel

Figure 1:
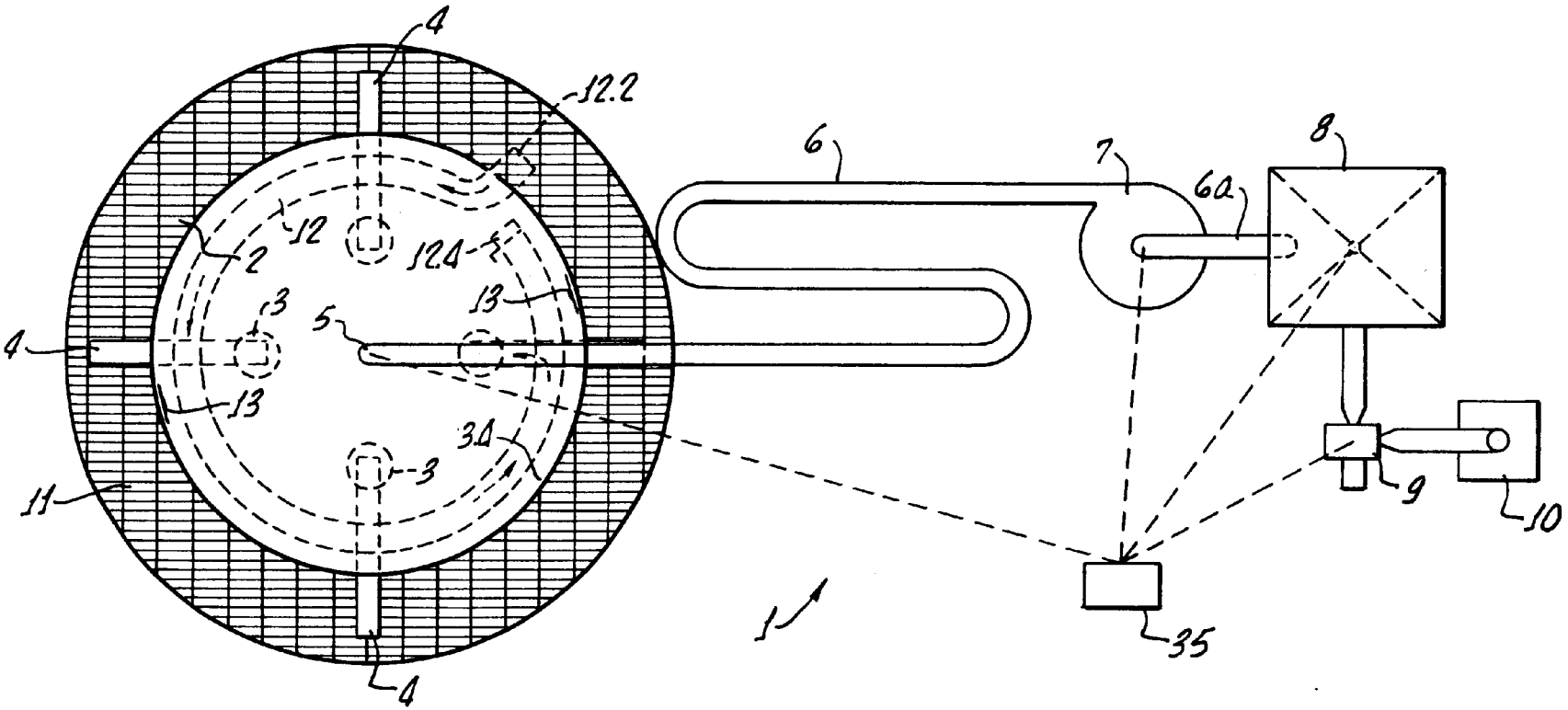
FIG. 1 is a schematic representation of the reactive waste deactivation facility in accordance with the present invention, showing a plurality of the deactivation bays, an outer expansion chamber enclosing the deactivation bays, an air pollution control system and other features.
Figure 2:
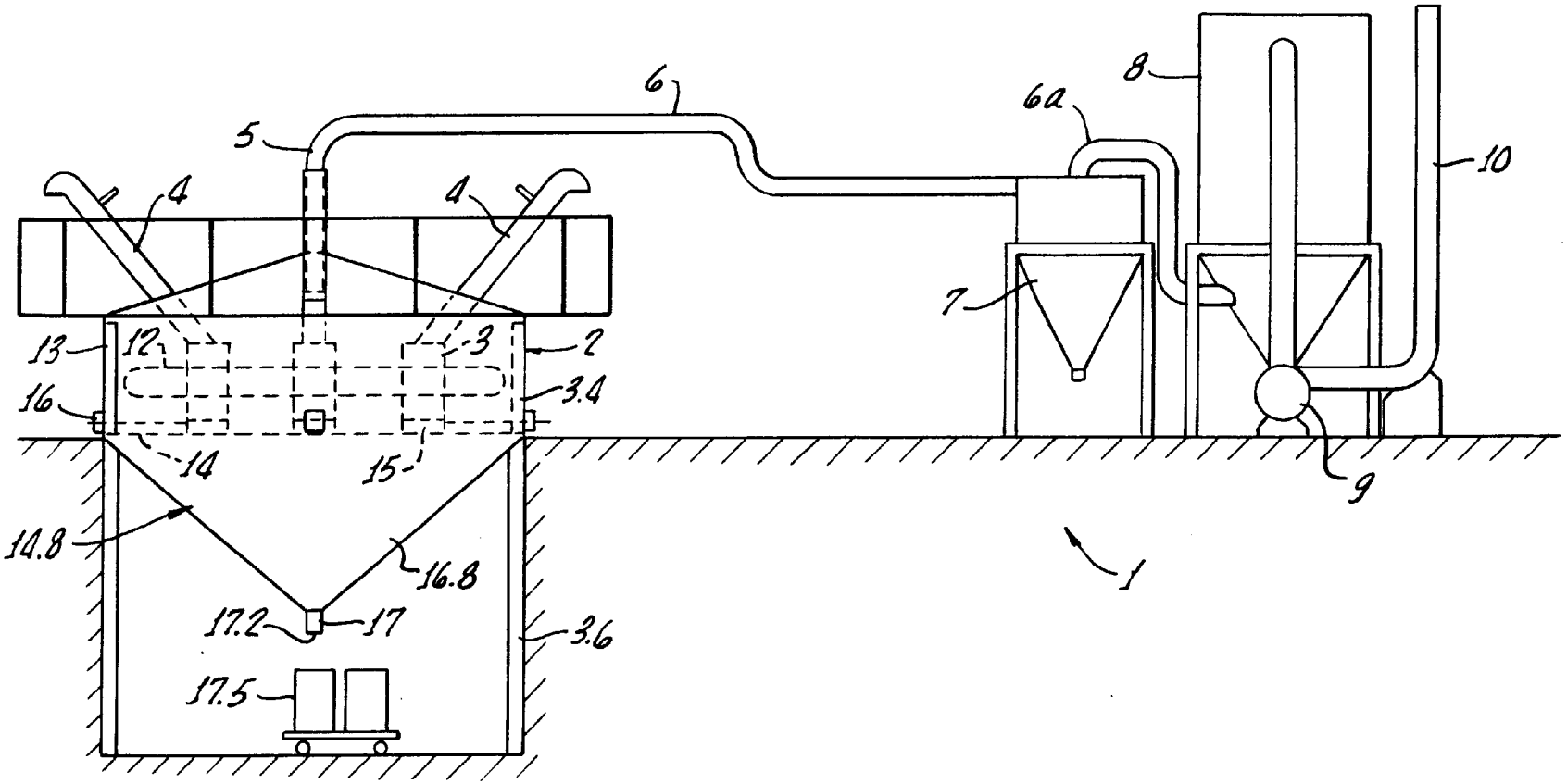
FIG. 2 is a partially cross sectional side view of the reactive waste deactivation facility shown in FIG. 1, showing angularly positioned feed chutes leading into each deactivation bay, and a residual waste removal system.

Turning now to FIGS. 1 and 2, a Reactive Waste Deactivation System 1 in accordance with the present invention is shown. The system 1 generally comprises an outer expansion chamber 2 enclosing a plurality of internal deactivation bays 3. The deactivation bays 3 in the presently shown embodiment are four in number, although it should be appreciated that with appropriate modification, there may be greater or less than four deactivation bays 3 enclosed within the common expansion chamber 2.

Preferably, the expansion chamber 2 is substantially cylindrical in shape. More specifically, the expansion chamber comprises a substantially circular vessel 3.4 which encloses the deactivation bays 3 and forms an upper portion of the chamber 2. In addition, the expansion chamber preferably comprises a waste collection vessel 3.6 which forms an underground lower portion of the chamber 2 (see FIG. 2) and is designed to collect reacted waste residual material such as ash and shrapnel.

The upper portion 3.4 of the expansion chamber 2 has an outside diameter of about 20 feet and a height of about 12 feet, and is structured to withstand substantial detonation force and to contain heat and gasses produced from deactivation reactions which take place in the internal deactivation bays 3. The upper portion 3.4 is structured to withstand a maximum credible event (MCE) of 1.2 pounds TNT equivalent detonation force. For example, wall thickness of the expansion chamber upper portion 3.4 is at least about ½ inch AISI 1020 steel (or equivalent material).

The deactivation bays 3 are each adapted to receive and deactivate certain types of hazardous reactive wastes. The system 1 preferably includes a feed system 3.8, in communication with each bay 3, which enables remote feeding of reactive waste into each one of the bays 3. Generally, the feed system 3.8 comprises a plurality of feed chutes 4, in this example four feed chutes 4, with each one of the feed chutes 4 being connected to an individual deactivation bay 3 as shown. As will be described in greater detail hereinafter, the feed chutes 4 safely convey the reactive waste to the deactivation bays 3. Gases from the deactivation reactions are collected in the expansion chamber 2 which provides the required volume for containment of the gas volume and heat produced by the reactions in the four reaction bays 3. Gases are removed from the chamber 2 via an exhaust system 5 and are carried to a cooling loop 6. From the cooling loop 6 the gas flow enters a cyclone 7 where the removal of large particles is completed and then the gas is inducted through a filtration unit 8, for example a bag house, where fine particles and other pollutants are removed. The air is moved through the system via an induced draft fan 9 and exits the through a stack 10.

FIGS. 1 and 2 further show that the expansion chamber 2 is surrounded by a feed platform 11 comprising for example a heavy steel flooring grate, that provides facility operators a secure and safe place to stand as they access the feed chutes 4 during loading (i.e. charging) of the reaction bays 3.

A process air supply line 12, or trunk line, at least partially encircles the expansion chamber 2 on the inside thereof connects to each of the reaction bays 3. This line 12 provides an induced air supply to the bays 3. The air supply line 12 begins outside of the expansion chamber 2 and terminates inside the chamber 2. In the shown embodiment of the invention, the air supply line 12 comprises duct 12.2, having an outside diameter of, for example, about sixteen inches, and is fabricated, for example, of 0.25" thick steel. At each end of the process air supply line 12 are sixteen inch blast gate valves 12.4 (shown in FIG. 1) used in balancing system air flows.

Shown in FIGS. 1 and 2, there are two full-size access doors 13, on opposing sides of the expansion chamber 2. Each door 13 may be fabricated from ½ inch thick material to withstand the maximum credible detonation event (MCE) of 1.2 pounds TNT equivalence. Although not shown in detail, each door 13 may include four hinges and three cross bars located between the hinges. Each cross bar may be ½ inch thick by 4 inches wide and approximately 48 inches long. Each hinge may be a 6 inch×6 inch blank hinge with a minimum 0.625 inch diameter pin.

As mentioned hereinabove, the expansion chamber 2 contains a plurality of deactivation bays 3, for example four deactivation bays, in which the deactivation reactions take place. (For this reason, the deactivation bays 3 may sometimes hereinafter be referred to as "reaction bays".) Although only four deactivation bays are shown, it is to be appreciated that in other embodiments of the invention, deactivation bays may be more or less in number. For example, six or eight bays may be provided, all enclosed in a common, larger expansion chamber.

As will be described hereinafter, the reaction bays 3 vary in design, shape, or size to account for the three types of reactive wastes to be treated in this facility 1. Preferably, the facility 1 is designed so the reaction bays 3 may be interchanged or replaced as required.

Each of the bays 3 is preferably attached to an industrial grating 14 which supports the bays 3, supports foot traffic inside the expansion chamber 2 when it is not operating, and allows ash and residue to fall through the grating 14. The grating 14 is supported, for example, by one or more support members, for example, multiple 3"×3" angle connectors, attached to an interior side of the expansion chamber 2. The grating is preferably additionally supported near the center of the expansion chamber, for example by means of a raised channel in about the center of the expansion chamber 2. Preferably, the grating 14 is designed to be removable in order to clean/remove residue from the interior of the expansion chamber 2.

Figure 3:
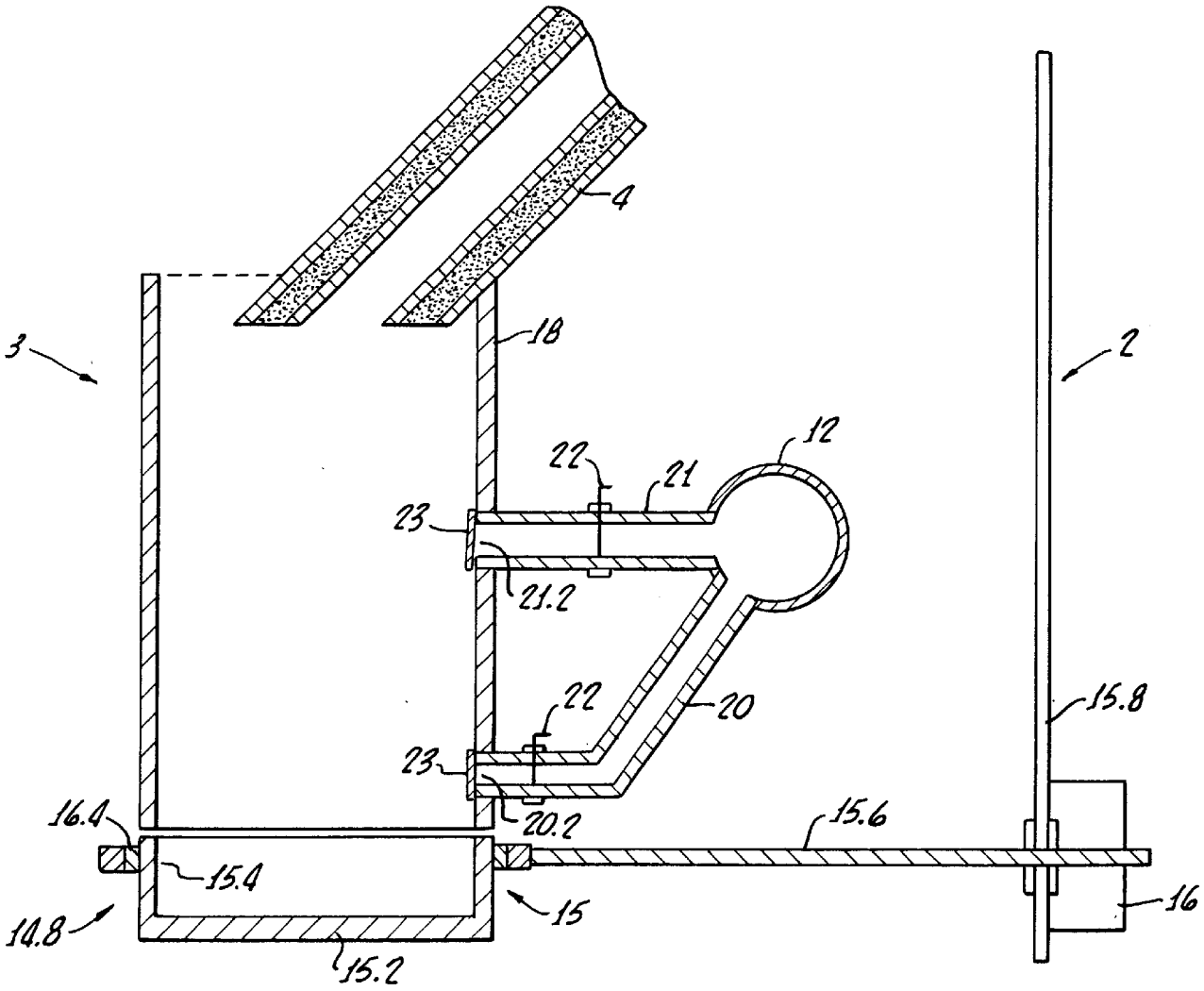
FIG. 3 is a cross sectional view of one of the deactivation bays, showing an air supply system and a releasable, movable bay floor for removing accumulated residual waste.
Figure 4:
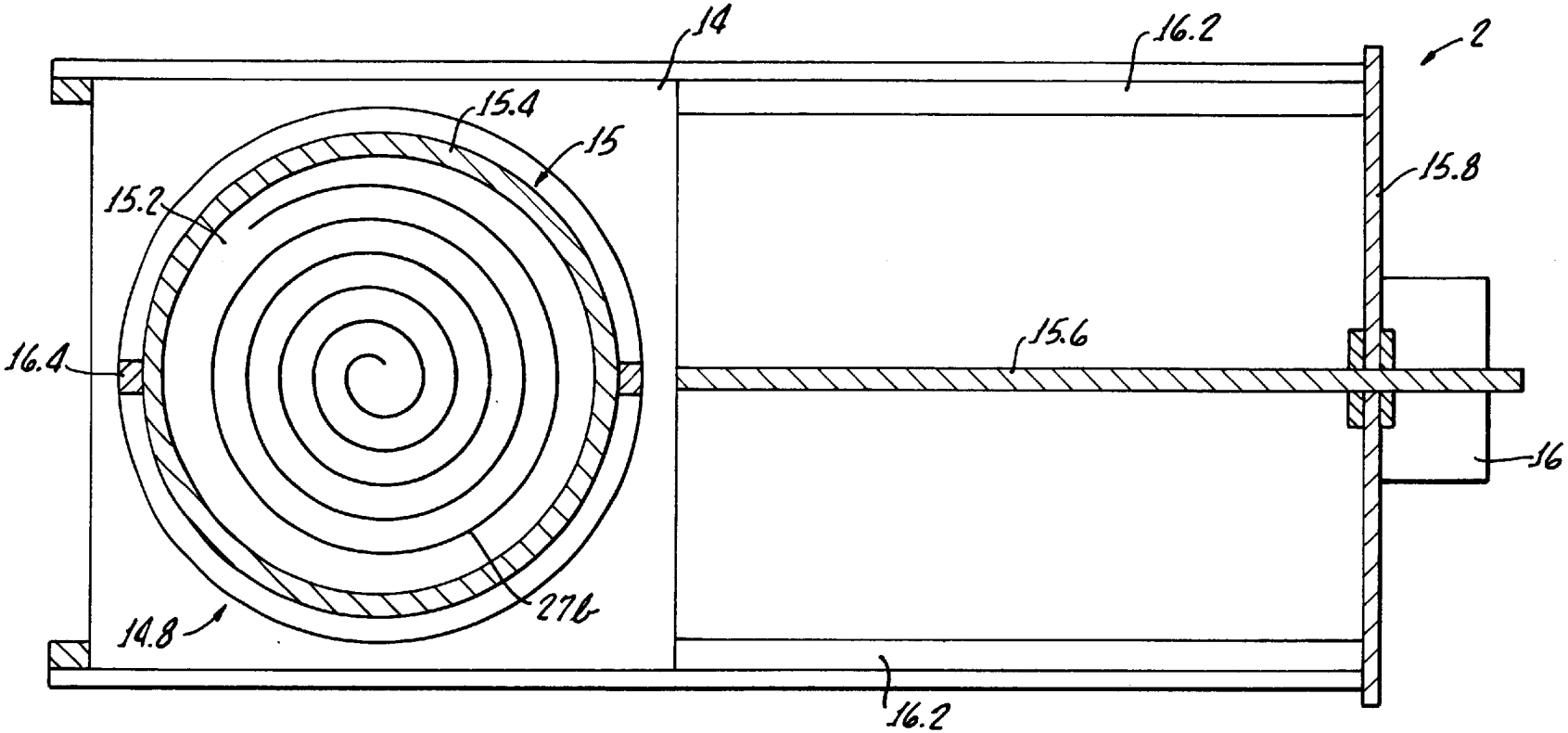
FIG. 4 is a top view of the releasable, movable bay floor feature shown in FIG. 3.

Referring now specifically to FIGS. 3 and 4, another feature of the present invention is shown. More specifically, the facility 1 preferably further comprises a waste collection system 14.8 More specifically, the waste collection system 14.8 comprises means for collecting and removing residuals, such as ash and shrapnel, resulting from the deactivation reactions in the bays 3. For example, each deactivation bay 3 may be equipped with a movable floor plate 15, comprising for example, a one inch thick steel bay floor plate 15. The floor plate 15 functions in part as a waste accumulation container. During waste treatment operations, ash, shrapnel and metal parts will accumulate in the bay 3 as a residue. In addition, the floor plate preferably operates as a dumping bucket.

Referring now as well to FIG. 4, the movable floor 15 of the bay 3 comprises a steel plate 15.2, for example having a thickness of about 1.0 inches, and having short upturned side walls 15.4. The sidewalls 15.4 of the movable floor 15 are preferably at least about six inches in height in order to contain all residue until it is completely combusted.

The floor 15 is generally movable in a back and forth direction under the reaction bay 3 and is also pivotal to enable an operator to dump residuals between reactions. An actuator arm 15.6 extends from the bay floor 15 through a nearest wall portion 15.8 of the expansion chamber 2 as shown. A remotely operable dumping mechanism 16 connected to the actuator arm 15.6, is provided on an opposing side of the expansion chamber wall 15.8.

Upon actuation of the dump mechanism 16, the actuator arm 15.6 pulls the steel bay floor plate 15.2 along a track 16.2 until it is completely clear of the reaction bay 3. The steel bay floor plate 15.2 is preferably attached to the actuator arrm 15.6 by a gymbel device 16.4 which provides for the plate 15.2 to rotate or swivel in order to dump its contents of ash and other residuals. After the dumping operation, the actuator arm 15.6 reverses and returns the bay floor plate 15.2 to its original position at the base of the reaction bay 3 ready for the next treatment cycle.

Turning now back to FIG. 2, upon activation of the dumping mechanism 16, the reacted ash and other residual material in the bay 3 falls by gravity to a tank bottom 16.8, and the material subsequently accumulates within a dump chute 17. From here the material collects until dump chute 17 is opened at outlet 17.2, allowing the material to be discharged, for example, into a collection hopper 17.5 or other mobile collection container.

Referring back now to FIG. 3, a cross sectional view of one of the reaction bays 3 is shown. The bay 3 may be substantially cylindrical in form, and constructed, for example, from mild steel, having a thickness of at least about ½ inch., The steel is rolled and welded to form the substantially cylindrical reaction bay 3 having walls 18 of at least about ½ inch thick. The reaction bay may have an inside diameter of about 24 inches.

Means for venting air to the bays 3 and the expansion chamber 2 are provided.

Preferably, the process air supply line 12 controls outside air induced into the system, for example, from an air pollution control system fan (not shown in FIG. 3). Each reaction bay 3 has lower air supply line 20, for example, a three inch diameter air line, connected to a lower air supply inlet 20.2 disposed in a lower portion of each of the reaction bay 3. In addition, a middle air supply line 21, for example, a four inch diameter air line, is provided for supplying an air flow from the process air supply line 12 through middle air supply inlet 21.2. The middle air supply line 21 enters tangentially to the center portion of the reaction bay 3.

Referring still to FIG. 3, dampers 22, disposed on both the lower air supply line 20 and the middle air supply line 21, control the air supply into to the reaction bay 3 though each air supply inlet 20.2, 21.2. Preferably, each air supply line 20, 21, includes a screen 23 placed over its respective inlet 20.2, 21.2 to minimize blow back of items from the reaction bays 3 into the air duct 12. Turning back now briefly to FIGS. 1 and 2, all air flow into the bays 3 may be induced flow from the baghouse fan 9. Air enters the process air supply line 12 through the open end 12.4 where it enters the expansion chamber 2 and connects to each of the bays 3 through the inlets 20.2 and 21.2 as shown in FIG. 3.

Each of the bays 3 is adapted to accommodate a particular class of reactive waste to be deactivated therein. In a preferred embodiment of the invention, referring now to FIGS. 5, 6 and 7, at least one of the bays 3 comprises a burning bay 3*a* shown in FIG. 5 which is fired by an ignition or sparking device 26. At least one of the bays 3 comprises a popping and melting bay 3*b*, shown in FIG. 6, which is fired by a heating device 27. At least one of the bays 3 comprises a detonation bay 3*c*, shown in FIG. 7, which is fired by a shielded heating device 29, for example a heating element imbedded in a bottom of a relatively thick bay floor plate 29.2.

Figure 5:
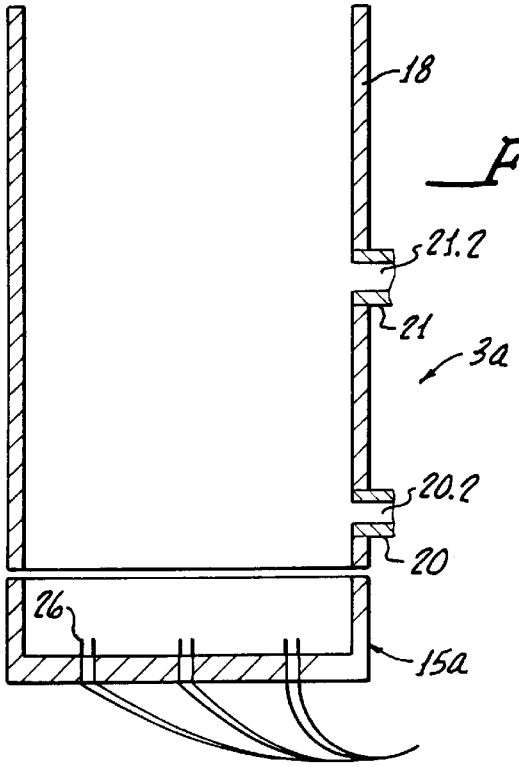
FIG. 5, 6, and 7 are cross sectional views of the three different types of deactivation devices used in the bays, particularly an ignition device, a heating device and a shielded heating device, respectively.
Figure 6:
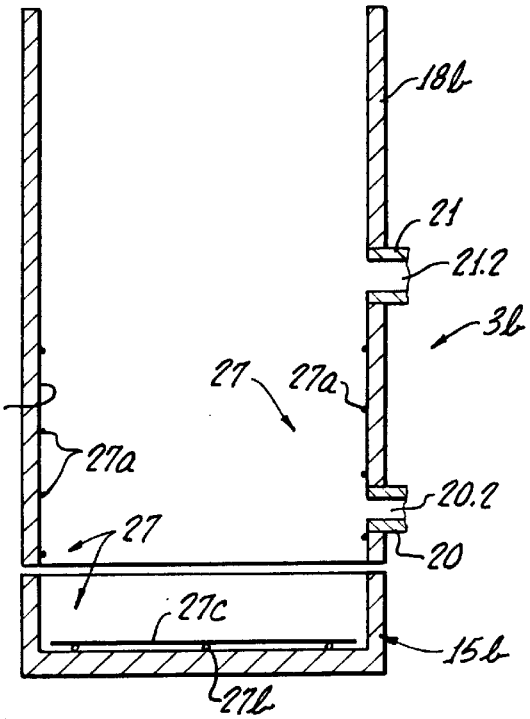
Figure 7:
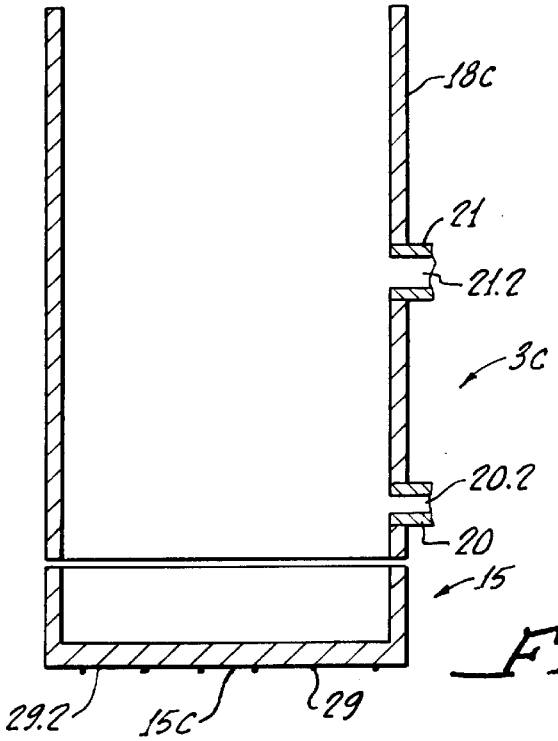

The deactivation devices 26, 27, and 29 shown in FIGS. 5, 6 and 7 respectively, are preferably electrically operated. It is to be appreciated however, that with appropriate modifications, the bays 3*a*, 3*b* and 3*c* can also be fired by natural gas or fuel oil burners in a different embodiment of the invention not shown herein, wherein the embodiment is designed so that it is not considered an incinerator by the US EPA.

The burn or deflagration bay 3*a* is shown in FIG. 5. Waste material treated in this type of bay 3*a* is highly combustible and maintains combustion once it is ignited. In some cases a material such as charcoal can be mixed with the waste feeds to further sustain combustion. The deactivation device 26 preferably comprises electric arc ignitors 26 attached to the steel bay floor plate 15*a* which are used to ignite the waste material.

The electrically initiated popping and melting bay 3*b* is shown in FIG. 6. The reaction bay 3*b* is electrically heated, for example in the lower 6 inches of the bay wall 18 and on the top of the movable bay floor plate 15. More specifically, the electric heating element 27 comprises for example, a 0.49 inch diameter radiant heating rod including a coiled portion 27*a* disposed about the bottom portion 18*a* of the reaction bay walls 18, and a coiled portion 27*b* disposed in a circular pattern on top of the bay floor plate 15. A tray 27*c*, disposed on top of the coiled portion 27*b* may be provided for holding the items as they are heated thereon. All items treated in this bay 3*b* are heated by means of radiant heat, for a desired time and temperature period to assure complete reaction of the materials.

Shown in FIG. 7, the detonating bay 3*c* is adapted to withstand detonation forces of at least about a maximum credible detonation event (MCE) of 1.2 pounds TNT equivalence. The detonation bay 3*c* includes a relatively thicker steel bay wall 18*c* (in comparison to the other types of bays 3*a* and 3*b*. For example, the detonation bay walls 18*c* are preferably at least about 0.60 inch thick or greater. The heating element 29 heats the bay floor 15*c* to a temperature sufficient for causing the reactive waste to detonate. The heating element 29 may comprise for example a circular coiled heating rod 29 imbedded within the armored steel bay floor plate 29.2, specifically at a bottom of the plate 29.2 as shown such that the heating element 29 is shielded from detonation forces within the bay 3*c*. The steel bay floor plate 15*c* is preferably at least about 1.0 inch thick in order to prevent the heating rod 29 from being damaged by detonations of the waste items.

Turning back now briefly to FIG. 4, the bay floor 15 will have one of the ignitor means 26, radiant heating means 27, or detonation means 29, described hereinabove, as a part of its design. For example, FIG. 4 represents the bay floor plate 15.2 of the melting or popping bay 3*b* shown in FIG. 6, having the circular heating element 27*b* disposed on top the bay floor plate 15.

Figure 8:
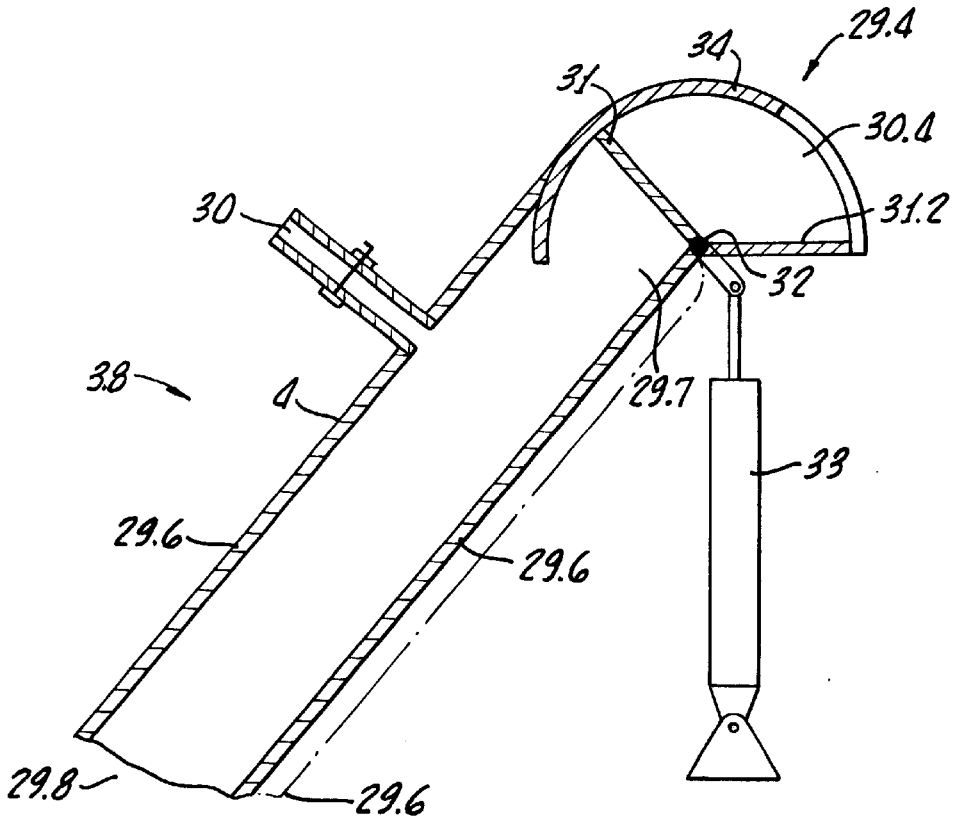
FIG. 8 is a cross sectional view of one of the feed chutes, wherein the feed chute includes a remotely operable rotary valve.

FIG. 8 shows a cross sectional view of one of the feed chutes 4 for enabling remote feeding of reactive wastes into each one of the deactivation bays 3. Preferably, the waste feed system 3.8 comprises a separate feed chute 4, such as the one shown in FIG. 8, for charging each reaction bay 3. The feed chute 4 may comprise a pneumatically actuated feed valve 29.4 for introducing the reactive wastes into the bay 3. The feed chutes 4 further comprise tubing 29.6 having a waste receiving end 29.7 and a waste ejection end 29.8.

Figure 8A:
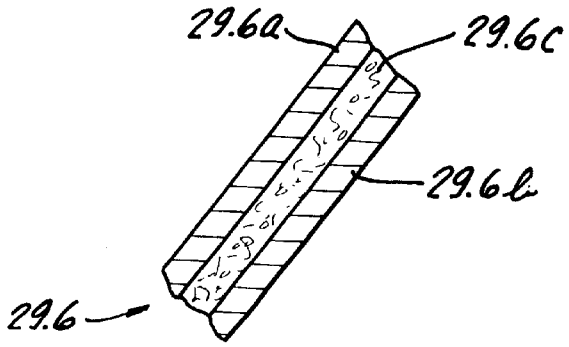
FIG. 8*a* is a cross sectional view of a portion of the feed chute shown in FIG. 8.

The chute tubing 29.6 is adapted to accommodate passage of reactive waste. For example, as shown in FIG. 8*a*, the tubing 29.6 is preferably thermally insulated and comprises for example two concentric, square, structural steel tubes, namely an outer tube 29.6*a* and an inner tube 29.6*b*, with a layer of suitable thermal insulation 29.6*c* therebetween. The outer tube 29.6*a* is approximately one foot square made from ⅜" structural steel. This will provide support for the entire chute 4. The inner tube 29.6*b* is a smaller structural steel tubing. The insulation 29.6*c* between these tubes 29.6*a* and 29.6*b* will be thermal ceramic fiber insulation or equal.

Turning back to FIG. 8, the feed chute 4 may be bolted to the expansion chamber 2 using a ¼" flange. Preferably, the feed chute 4 is mounted at an angle, for example an angle of at least about 50 degrees to ensure that the waste slides easily into the bay (not shown in FIG. 8). The concentric inner and outer tubes 29.6*a* and 29.6*b* of the chute 4 will be held together by ¼" plates welded at each end 29.7 and 29.8. However, preferably, at the ejection end 29.8 of the feed chute 4, the end plate is welded only to the outer tube 29.6*a*. With this design, the inner tube 29.6*b* will be free to move relative to the outer tube 29.6*a* to allow for thermal expansion. All exposed surfaces outside the contained burn expansion chamber are painted using high temperature aluminum paint.

At the top of the feed chute 4 for each bay 3 is a cooling air inlet duct 30 which allows the inflow of induced ambient cooling air down the feed chute 4 which keeps the chute 4 cool and prevents premature ignition of reactive materials. The reactive waste material is manually placed in a valve opening 30.4. The operator actuates the valve remotely to dump the waste into the chute 4 where it slides into the connected deactivation bay. The rotary valve 29.4 on each feed chute 4 is built to assure that at no time would the operator be exposed to a direct line of sight into any of the burn bays.

More specifically, the reactive waste is fed into the feed chutes 4 by the remote, pneumatically-actuated rotary valve 29.4. An L-shaped rotary door 31 accepts the waste, and as it rotates to dump the waste down the chute 4, a leg 31.2. of the door 31 rotates into the line of sight to assure that the opening is covered at all times. The rotary valve 29.4 comprises for example, a pivot shaft 32, actuator 33 a cowl 34, and the L-shaped rotary door 31. All exposed fabricated parts are painted with high temperature aluminum paint.

Preferably, the waste feed valves 29.4 of the system 1 are operated by a remote, pneumatic system. Each of the four cylinders is actuated by a manually operated, two way, four position valve. These valves are mounted on a panel which location places the operator furthest from the feed chutes during actuation.

Air Pollution Control System (APCS)

The Air Pollution Control System (APCS) shown in FIGS. 1 and 2, comprises the gas cooling system 6, the cyclone separator 7, the filtration unit or baghouse 8, the induced draft fan 9 with stack 10 and associated ducting. The internal operating temperature of the expansion chamber 2 is up to 625° Fahrenheit. The 625° Fahrenheit operating temperature is based on 250 pounds per hour of reactive material with a heat content of 8000 Btu/lbm and an induced ambient air flow for combustion/cooling of 2500 cfm into the expansion chamber 2. The filter baghouse 8 has an operating temperature of approximately 350° Fahrenheit which is provided by the cooling loop 6 in the system 1.

For example, the ducting 6 between the expansion chamber 2 and the cyclone 7 is formed in the shape of a twisted "S". This configuration results in approximately seventy five feet of duct 6 for cooling with an estimated temperature drop down to approximately 400° Fahrenheit. All ducting is fabricated from eleven gage steel and painted with a high temperature aluminum paint to resist corrosion/rusting. The diameter of the duct 6 between the expansion chamber and the cyclone 7 is preferably about sixteen inches to maintain a duct velocity between 3000 and 3500 feet per minute. A portion of duct 6*a* connected between the cyclone 7 and baghouse 8 has a larger size, for example of about eighteen inches in diameter, to accommodate the increased flow from the induced ambient cooling air. The draft fan 9 is sized to handle 5000 acfm at a corrected pressure drop of sixteen inch water column (wc). The stack 10 and all ducting downstream of the baghouse 8 are twenty inch diameter, fabricated from low carbon steel. All ducting is fabricated from eleven gage steel and painted with a high temperature aluminum paint to resist corrosion/rusting.

The cyclone 7 serves as a mixer for the exhaust gases and induced ambient cooling air to ensure a homogenous gas temperature of the exhaust stream prior to entering the baghouse 8 and to effectively remove the larger particles, including glowing embers or sparks that could possibly be entrained in the exhaust stream. The cyclone 7 removes these prior to the filter system to minimize the chance they could ignite any unburned, combustible material collected on the filter bags. The cyclone 7 is sized to operate at a pressure drop of approximately four inch water wc and will be fabricated from low carbon steel.

The main portion or component of the APCS is the filtration unit or baghouse 8. The filtration unit 8 is designed to handle the temperature of the exhaust gases and sized in relation to actual flow in acfm and the filter surface area. The filteration unit 8 is sized to have an "air to cloth" ratio of between four to six acfm for every square foot of filter media. Inducing 2500 standard cubic feet per minute (scfm, that is, air with a density of 0.075 lbra/ft3) results in an actual flow to the filter unit of 3966 actual feet per minute (acfm) at 350 degrees F. In addition, approximately 500 to 1000 acfm of induced cooling air is anticipated for a total flow to the baghouse 8 of approximately 5000 acfm.

For example, the baghouse 8 is sized to have approximately 1244 square feet of filter area. The baghouse 8 has a "reversed pulse" cleaning system to prevent pressure build-up as the filter bags start to load with dust, has top removal or access to the bags, high temperature construction and a ladder/cage assembly. The filter bag to be used is preferably a Nomex material with a Teflon membrane. This type of bag has excellent filtration characteristics and it is designed to operate at 350° Fahrenheit.

Computer Control System

A computerized control system 35 regulates the amount and type of waste feed, the heating of the bays 3, the system air flow, temperatures in the expansion chamber 2, the cooling loop system 6, the operation of the cyclone 7, the baghouse filter system 8, and the induced draft fan 9 to assure the system 1 operates within safety standards and that it complies with the applicable air pollution control standards. The unit 1 is designed to meet the U.S. Environmental Protection Agency standards set in regulations at 40 CFR 264.600 for Miscellaneous Treatment Units.

To calculate the air emission standards, the Pollu-10 (and updated model 13) computer model is used. This model has been widely used to calculate pollutant emissions produced by propellant and explosive reactions. Technical information on this computer model has been provided in U.S. Pat. No. 5,741,465. The present deactivation facility also uses this method to assure that facility air emissions comply with state and federal air emission standards. Emissions from each of the treatment bays are calculated prior to treatment and compared to state and federal air emission standards. The feed rates of reactive waste are then adjusted accordingly so that the emissions produced by the facility meet state and federal standards.

Although there has been hereinabove described a reactive waste facility and method in accordance with the present invention for the purposes of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A reactive waste deactivation facility comprising:

a deactivation system, including a plurality of deactivation bays, each adapted to receive and deactivate reactive waste, at least one of the deactivation bays comprising a bay having a movable floor element adapted to collect and discharge ash and residuals from a deactivation reaction in the bay, the movable floor element including a deactivation device incorporated into the movable floor element;

an outer expansion chamber, enclosing the plurality of deactivation bays, for containing heat and waste gases generated during the deactivation of the reactive waste in the deactivation bays; and an air pollution control system, connected to the expansion chamber, for receiving and treating the waste gasses.

2. The facility according to claim 1 wherein each one of the plurality of deactivation bays includes a deactivation device, and a number of the deactivation bays include different types of deactivation devices, each type of deactivation device being configured for deactivation a different class of reactive waste.

3. The facility according to claim 1 wherein a number of the plurality of deactivation bays include different types of deactivation devices, in which each type of deactivation device is selected from a group consisting of a sparking device for deactivating reactive waste by deflagration, a radiant heating device for deactivating reactive waste by melting or popping the waste, and a shielded heating device for deactivating reactive waste by detonating the waste.

4. The facility according to claim 1 wherein the plurality of deactivation bays comprises four deactivation bays.

5. The facility according to claim 4 wherein each of the four deactivation bays includes a deactivation device selected from a group consisting of a sparking device for deactivating reactive waste by deflagration, a radiant heating device for deactivating reactive waste by melting or popping the waste, and a shielded heating device for deactivating reactive waste by detonating the waste.

6. The facility according to claim 1 wherein each deactivation bay comprises an open top steel cylinder.

7. The facility according to claim 1 wherein the movable floor includes an electric heating coil.

8. The facility according to claim 1 further comprising a waste collection system, including a movable floor plate connected to each one of the plurality of deactivation bays, for collecting and removing accumulated ash and residuals resulting from the deactivation reactions.

9. The facility according to claim 8 wherein the waste collection system further includes a waste collection vessel, forming an underground portion of the expansion chamber.

10. A reactive waste deactivation facility comprising:

a deactivation system, including a plurality of deactivation bays, each adapted to receive and deactivate reactive waste;

an outer expansion chamber, enclosing the plurality of deactivation bays, for containing heat an[0084] waste gases generated during the deactivation of the reactive waste in the deactivation bays, the expansion chamber being structured to withstand a maximum credible event of about 1.2 pounds TNT equivalent detonation force; and an air pollution control system, connected to the expansion chamber, for receiving and treating the waste gases.

11. A reactive waste deactivation facility comprising:

a deactivation system, including a plurality of deactivation bays, each adapted to receive and deactivate reactive waste;

an outer expansion chamber, enclosing the plurality of deactivation bays, for containing heat and waste gases generated during the deactivation of the reactive waste in the deactivation bays;

an air pollution control system, connected to the expansion chamber, for receiving and treating the waste gasses; and an air cooling system, including an air supply line connected between each of the deactivation bays.

12. The facility according to claim 11 wherein the air supply line includes remotely controlled dampers on the air supply line for controlling air flow to each deactivation bay.

13. A reactive waste deactivation facility comprising:

a deactivation system, including a plurality of deactivation bays, each adapted to receive and deactivate reactive waste;

an outer expansion chamber, enclosing the plurality of deactivation bays, for containing heat an[0084] waste gases generated during the deactivation of the reactive waste in the deactivation bays;

an air pollution control system, connected to the expansion chamber, for receiving and treating the waste gasses; and a feed system, in communication with each bay, for enabling remote feeding of reactive waste into each of the deactivation bays, the feed system comprising a plurality of separate feed chutes, with each on of the separate feed chutes being connected to an individual one of the plurality of deactivation bays.

14. A reactive waste deactivation facility comprising:

a deactivation system, including a plurality of deactivation bays, each adapted to receive and deactivate a different class of reactive waste;

an outer expansion chamber, enclosing the plurality of deactivation bays and adapted to contain waste gases generated during the deactivation of the reactive waste in the deactivation bays;

a waste feeding system, including an individual feed chute having a remotely operated rotary valve, connected to each deactivation bay;

a waste collection system, including a movable floor element connected to each deactivation bay and further including a waste collection vessel forming a portion of the expansion chamber, the waste collection vessel forming an underground portion of the expansion chamber; and an air pollution control system connected to the expansion chamber, for receiving and treating the waste gasses.

15. The facility according to claim 14 further comprising an air cooling system, including an air supply line connected between each of the deactivation bays.

16. The facility according to claim 15 wherein the air supply line includes remotely controlled dampers on the air supply line for controlling air flow to each deactivation bay.

17. The facility according to claim 16 wherein the air cooling system further includes an induced air fan connected to the air pollution control system and adapted to cool waste gasses exiting the expansion chamber.

* * * * *